US006356172B1

(12) United States Patent
Koivisto et al.

(10) Patent No.: US 6,356,172 B1
(45) Date of Patent: Mar. 12, 2002

(54) RESONATOR STRUCTURE EMBEDDED IN MECHANICAL STRUCTURE

(75) Inventors: Markku Koivisto, Helsinki; Olli Salmela, Espoo; Hans Somerma, Veikkola; Kalle Jokio, Helsinki, all of (FI)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/474,724

(22) Filed: Dec. 29, 1999

(51) Int. Cl.[7] ..... H01P 7/06
(52) U.S. Cl. ..... 333/231; 333/227; 333/230
(58) Field of Search ..... 333/230, 231, 333/227

(56) References Cited

U.S. PATENT DOCUMENTS 4,211,987 A * 7/1980 Pan ..... 333/230
4,232,277 A * 11/1980 Dickens et al. ..... 333/230
4,758,922 A 7/1988 Ishigaki et al.
5,218,374 A * 6/1993 Koert et al. ..... 343/789
5,799,247 A 8/1998 Lapinlampi
5,821,836 A 10/1998 Katchi et al.

FOREIGN PATENT DOCUMENTS

EP 0 963 001 A2 12/1999

OTHER PUBLICATIONS

I. Song et al., "*Phase Noise Enhancement of the GaAs High Electron Mobility Transistors Using Micromachined Cavity Resonators at Ka–band*", Publication Board, Japanese Journal of Applied Physics, Accepted for Publication May 6, 1999, p. L601.

* cited by examiner

*Primary Examiner*—Benny Lee
*Assistant Examiner*—Patricia T. Nguyen
(74) *Attorney, Agent, or Firm*—Cohen, Pontani, Lieberman & Pavane

(57) ABSTRACT

An assembly for supporting a substrate of an integrated circuit and forming a cavity resonator with the substrate. The assembly includes a baseplate in which a cavity for the cavity resonator is integrally formed. A substrate is mounted over the cavity resonator in the baseplate and an excitation coupling extends into the cavity of the cavity resonator.

30 Claims, 3 Drawing Sheets

RESONATOR STRUCTURE EMBEDDED IN MECHANICAL STRUCTURE

BACKGROUND OF THE INVENTION

1. Field of the Invention

The present invention relates to a resonator incorporated in a baseplate of an integrated circuit module.

2. Description of the Related Art

Waveguide resonators are designed to operate at a resonant or natural frequency and store oscillating energy that is oscillating at or near the resonant frequency for time periods that are long relative to a period of the resonant frequency. Oscillating energy that is not oscillating at or near the resonant frequency is not stored for an appreciable amount of time. Resonators are described in terms of their quality factor Q which is dependent on a ratio of the maximum stored energy to the energy dissipated per cycle at a given frequency. Cavity resonators generally exhibit the highest Q values. However, the size of the cavity required to produce the desired resonant frequency makes it difficult to mount and connect to an integrated circuit module. For this reason, thin film resonators and dielectric resonators are used instead of cavity resonators because they are easier to attach to integrated circuit modules as discrete components. The use of thin film resonators or dielectric resonators instead of cavity resonators facilitates installation of the resonator on an integrated circuit module at the expense of having a lower Q value.

A prior art filter having cavity resonators is disclosed in U.S. Pat. No. 5,799,247 for use with radio equipment in which cavity resonators are included in the design of a shell for the body of the radio equipment. In this device, the shell is designed to include the required size of the cavity. To accommodate the depth of the cavity, which is larger than the thickness of the shell, the shell includes an expanded portion formed with a large enough depth to house the cavity. Accordingly, the shell must be specifically designed for the cavity for a specific circuit. If a resonator with different characteristics is to be used, i.e., for a different application, a new shell must be designed. Furthermore, the printed circuit board on which the circuit is arranged is connected to a different portion of the shell. Therefore, the resonator still requires external connections to both the input and output of the resonator.

SUMMARY OF THE INVENTION

It is an object of the present invention to provide a cavity resonator as an integral part of an electronic module.

The object of the present invention is achieved by an assembly for supporting a substrate of an integrated circuit that includes a baseplate for supporting the substrate and a cavity resonator having a cavity embedded in the baseplate. An excitation coupling of the cavity resonator is connectable to the integrated circuit of the substrate that is supportable on the baseplate. The substrate itself is mounted on the baseplate so that it covers the cavity and is therefore, an integral part of the cavity. The substrate may comprise a multi-layer substrate such as a laminate printed circuit board, a ceramic circuit board, or a thin film circuit board.

The baseplate comprises a material consisting of one of Kovar, CuW, and CuMo. The cavity of the cavity resonator may be circular or rectangular. However, a circular shape is preferred because it is easier to machine into the baseplate.

A tuner, such as a screw plunger, may be arranged in said baseplate for adjusting the resonant frequency of the cavity resonator.

The integrated circuit is mounted on the substrate and may be one of a flip chip, a bond chip, and a monolithic microwave integrated circuit.

The assembly of the present invention may further comprise a metal structure on which the baseplate is mounted. The metal structure may be a heat sink for the integrated circuit and substrate. Furthermore, the metal structure may include a waveguide for connecting the substrate to a further component, such as an antenna filter of a transmitter or receiver.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
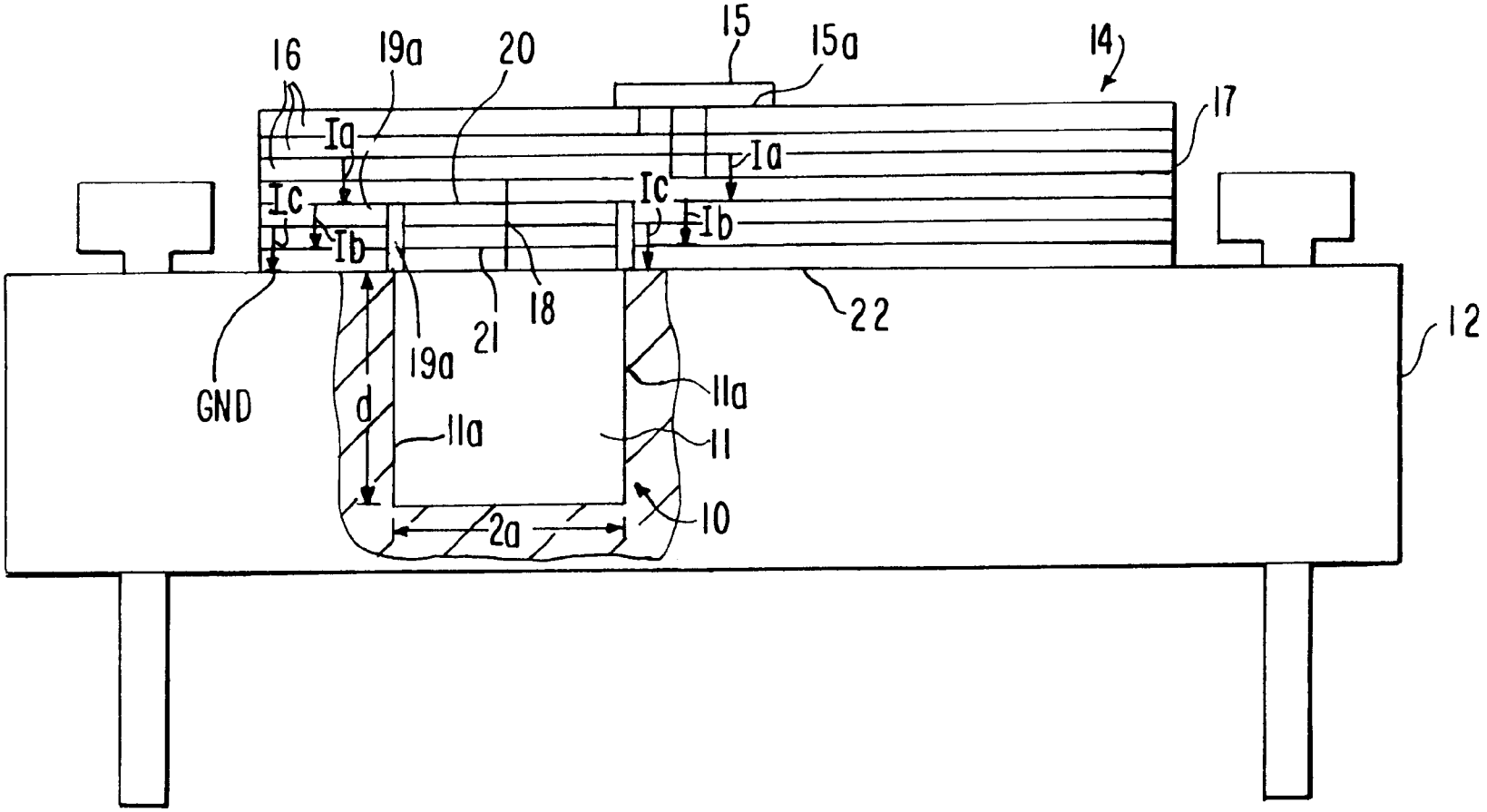
FIG. 1 shows a multi-chip module mounted on a baseplate having an integrated cavity resonator according to an embodiment of the present invention.

FIG. 1 shows an arrangement of a cavity 11 for a cavity resonator 10 integrated into a baseplate 12 on which a multi-chip module (MCM) 14 is mounted. The MCM 14 comprises an integrated circuit 15 mounted on a substrate 17. The integrated circuit 15 may comprise any type of circuit requiring a resonator such as, for example, a voltage controlled oscillator (VCO) or a filter. The integrated circuit 15 is connected to the cavity resonator 10 via an excitation coupling 18. The substrate 17 closes the cavity 11 and includes vias 19, i.e., passages through multiple layers of the substrate 17. The vias 19 are arranged so that the bottom of each of the vias is in communication with walls 11*a* of the cavity 11. The vias 19 may be, for example, 100–200 $\mu$m in diameter and may be arranged along the wall 11*a* of the cavity 11 at a pitch of, for example, 200–450 $\mu$m. The vias 19 each have a via wall 19*a* which extend the wall 11*a* of the cavity 11 inside the MCM 14. If the cavity 11 is circular, the vias 19 also form a circular frame in the MCM 14 (See FIGS. 1*a*–1*c*). Accordingly, the substrate 17 forms a part of the cavity 11. In FIG. 1, the integrated circuit 15 is shown as a bonding or flip chip. However, the integrated circuit may comprise a Monolithic Microwave Integrated Circuit (MMIC) chip.

Figure 1A:
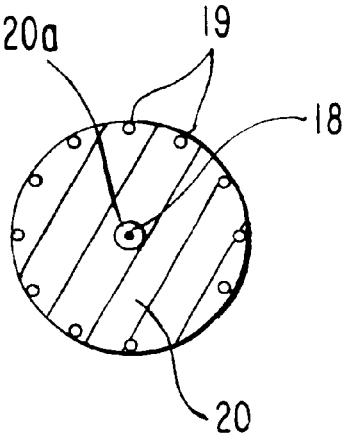
FIGS. 1*a*–1*c* show various layers of the multi-chip module of FIG. 1 above the cavity resonator.
Figure 1B:
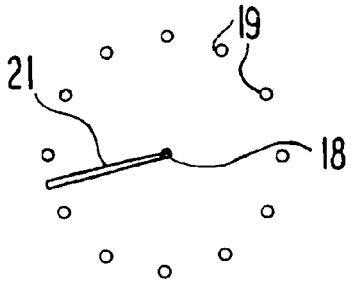
Figure 1C:
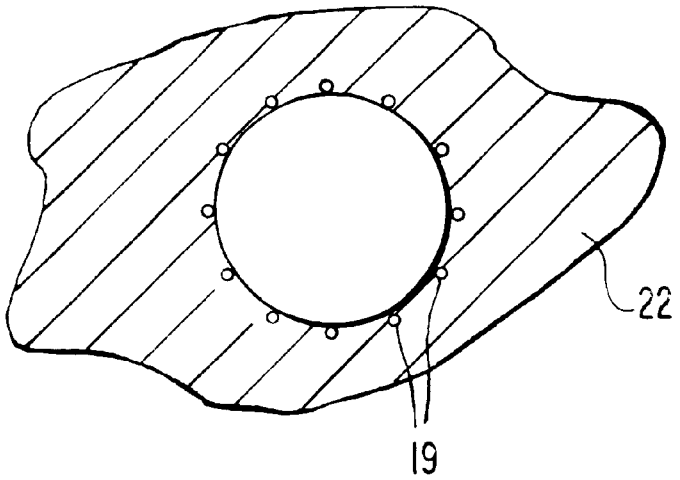

The MCM 14 includes a plurality of layers 16 between which the various conductors are arranged for interconnecting the various parts of the integrated circuit 15 to various signals including, but not limited to, external voltage sources, grounds, control signals, and the cavity resonator 10 input signal via a connection to the excitation coupling 18. As shown in FIG. 1*a*, the top of the vias 19 are connected by a grounded conductor 20 between two layers 16 which covers the area above the cavity 11 except for a void 20*a* around the excitation coupling 18. It should be noted that the excitation coupling 18 does not have to be centered with respect to the middle of the cavity 11. Referring to FIG. 1*b*, one or more of the vias 19 may be connected to the excitation coupling by a connector 21 running between two layers of the substrate 17 between the top and the bottom of the vias 19. FIG. 1*c* show that the bottom of the vias 19 are connected to a ground 22 arranged on the bottom of the substrate 17 and which surrounds the cavity 11. The integrated circuit 15 may, for example, be connected to the excitation coupling conductor via a ball connection. However, any other known connection for connection an integrated circuit to a substrate may also be used.

The cavity resonator 10 comprises a cavity 11 which may, for example, be a circular or rectangular in shape. However, a circular resonator is preferable because the circular shape is easier to machine into the baseplate 12. The baseplate 12 comprises a material that has a coefficient of thermal expansion value that is similar to the coefficient of thermal expansion value of the MCM 14. Therefore, when the MCM 14 comprises ceramic materials, the baseplate 12 may for example comprise Kovar, CuW, or CuMo. Of course, the baseplate 12 may comprise other materials having a coefficient of thermal expansion that is similar to the MCM 14, especially when the MCM 14 comprises materials other than ceramics such as a laminate or silicon. In the present invention, the multi-layer MCM 14 is an integral part of the resonator 10. Only one port of the cavity resonator 10 is connected to the integrated circuit 15 via the excitation coupling 18. The second port is connected to the substrate 17 of the MCM 14. The substrate 17 of the MCM 14 may comprise a laminate printed circuit board in which the layers 16 are glass fiber and epoxy, a ceramic circuit board in which the layers 16 comprise ceramic layers, and a thin film circuit board in which the layers 16 comprise thin films.

Figure 2:
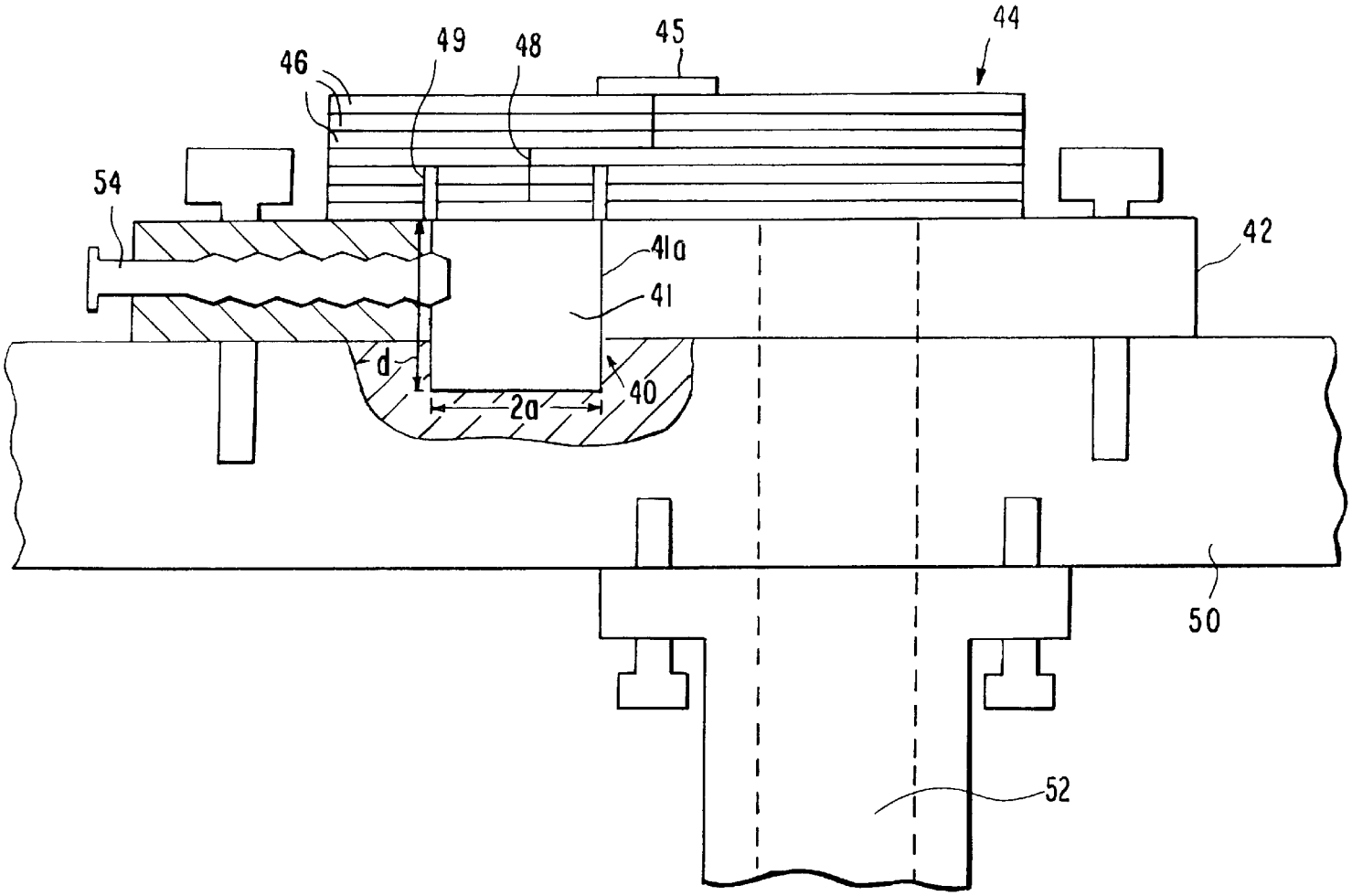
FIG. 2 shows a multi-chip module mounted on a baseplate and further connected to a further support according to another embodiment of the present invention.

In the embodiment of the present invention shown in FIG. 2, a cavity 41 of a cavity resonator 40 is required to be deeper than the thickness of a baseplate 42. Therefore, the cavity resonator 40 may be arranged so that it extends through the baseplate 42 and into a support 50 on which the baseplate 42 is mounted. The structure including the baseplate 42 and the support 50 is used in transmitters and receivers located on point-to-point and point-to-multipoint radio links, i.e., base stations. The cavity 41 has walls 41*a* that are connected to an MCM 44 having layers 46 using vias 49. Furthermore, an excitation coupling 48 connects the cavity resonator 40 to an integrated circuit 45. The vias 49, MCM 44, excitation coupling 48 and integrated circuit 45 function the same as the vias 19, MCM 14, excitation coupling 18 and integrated circuit 15 described above with reference to FIG. 1.

FIG. 2 further shows that the support 50 to which the baseplate 42 is attached may be used for supporting another function of the integrated circuit 45. For example, the structure 50 may comprise a metal heat sink and may also include a waveguide 52 to a further component such as an antenna filter for a transmitter or receiver.

Furthermore, the cavity resonator 40 may be tuned using a tuner such as a screw plunger 54 as shown in FIG. 2. The use of a screw plunger 54 as a cavity tuner may also be implemented in the FIG. 1 embodiment.

Referring to FIGS. 1 and 2, a first specific example of a cavity resonator constructed in accordance with the present invention includes a TM010 circular-type resonator with dimensions a=10 mm, d=10 mm and may be excited with either a loop or a sonde excitation loop. A second specific example of a resonator includes a TE111 circular-type resonator with dimensions a=25.5, d=16 mm which may be excited with a loop coupling. Instead of the couplings depicted, any other known excitation couplings may also be used. The examples mentioned may be implemented in the cavity resonator 10 in FIG. 1 or the cavity resonator 40 shown in FIG. 2.

Thus, while there have shown and described and pointed out fundamental novel features of the invention as applied to preferred embodiments thereof, it will be understood that various omissions and substitutions and changes in the form and details of the methods disclosed and devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is also to be understood that the drawings are not necessarily drawn to scale but that they are merely conceptual in nature. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An assembly for supporting a substrate of an integrated circuit so as to form a resonator cavity, comprising a baseplate having an upper surface onto which the substrate of the integrated circuit is mountable, a cavity being formed in said baseplate, the cavity having an open end in the upper surface of said baseplate, the substrate of the integrated circuit closing the open end of the cavity in said baseplate when the substrate is mounted on the upper surface of the baseplate so that the cavity is suitable for use as a cavity resonator, and a tuner arranged in said baseplate for adjusting a resonant frequency of said cavity resonator.

2. The assembly of claim 1, wherein said baseplate comprises a material consisting of one of Kovar, CuW, and CuMo.

3. The assembly of claim 1, wherein said cavity comprises a shape consisting of one of a circle and rectangle.

4. The assembly of claim 1, wherein said tuner comprises a screw plunger insertable into said cavity through said baseplate.

5. The assembly of claim 1, in combination with a substrate on which the integrated circuit is mountable, said substrate being mounted on said baseplate an d covering said open end of said cavity so that said substrate closes said open end and thereby forms a part of said cavity of said cavity resonator.

6. An assembly in combination with a substrate on which an integrated circuit is mountable, said assembly being arranged for supporting said substrate of the integrated circuit and forming a resonator cavity, said assembly comprising a baseplate having an upper surface onto which said substrate of the integrated circuit is mountable, a cavity being formed in said baseplate, the cavity having an open end in the upper surface of said baseplate, said substrate of the integrated circuit being mounted on said baseplate and closing the open end of the cavity in said baseplate and thereby forming a part of said cavity so that said cavity is suitable for use as a cavity resonator, wherein said substrate comprises of plurality of layers and a plurality of vias extending upward from a bottom of said substrate, each said plural vias having an upper end, a bottom end, and via walls and being arranged such that a bottom of each of said plural via walls is in communication with said side wall of said cavity, said plural vias thereby extending said cavity into said substrate such that said substrate comprises a part of said cavity.

7. The assembly of claim 6, wherein each said plural vias comprises a diameter within the range including 100–200 $\mu$m.

8. The assembly of claim 6, wherein said plural vias are arranged about an upper perimeter of said cavity at a pitch within the range including 200–450 $\mu$m.

9. The assembly of claim 6, further comprising a connector arranged between two of said plural layers for connecting the upper ends of said plural vias.

10. The assembly of claim 9, wherein said plural vias are connected to an electrical ground in said substrate.

11. The assembly of claim 9, wherein said substrate further comprises an excitation coupling extending between said plural vias.

12. The assembly of claim 11, wherein said excitation coupling is connected to one of said plural vias by a conductor arranged between two of said plural layers.

13. The assembly of claim 6, in combination with an integrated circuit mounted on said substrate and connected to said cavity resonator via an excitation coupling, said integrated circuit comprising one of a flip chip, a bond chip, and a monolithic microwave integrated circuit.

14. The assembly of claim 13, wherein said integrated circuit comprises a voltage controlled oscillator.

15. An Assembly in combination with a substrate on which an integrated circuit is mountable, said assembly being arranged for supporting said substrate of the integrated circuit and forming a resonator cavity, said assembly comprising a baseplate having an upper surface onto which said substrate of the integrated circuit is mountable, a cavity being formed in said baseplate, the cavity having an open end in the upper surface of said baseplate, said substrate of the integrated circuit being mounted on said baseplate and closing the open end of the cavity in said baseplate and thereby forming a part of said cavity so that said cavity is suitable for use as a cavity resonator, said assembly further comprising a metal structure, wherein said baseplate is mounted on said metal structure and said cavity extends from said surface area through said baseplate and into said metal structure.

16. The assembly of claim 15, wherein said metal structure comprises a heat sink.

17. The assembly of claim 15, wherein said metal structure further comprises a waveguide for connection to a further component.

18. The assembly of claim 15, wherein said baseplate comprises a material consisting of one of Kovar, CuW, and CuMo.

19. The assembly of claim 15, wherein said cavity comprises a shape consisting of one of a circular and rectangular shape.

20. The assembly of claim 15, further comprising a tuner arranged in said baseplate for adjusting a resonant frequency of said cavity resonator.

21. The assembly of claim 20, wherein said tuner comprises a screw plunger insertable into said cavity through said baseplate.

22. The assembly of claim 15, wherein said substrate comprises of plurality of layers and a plurality of vias extending upward from a bottom of said substrate, each said plural vias having an upper end, a bottom end, and via walls and being arranged such that a bottom of each of said plural via walls is in communication with said side wall of said cavity, said plural vias thereby extending said cavity into said substrate such that said substrate comprises a part of said cavity.

23. The assembly of claim 22, wherein each said plural vias comprises a diameter within the range including 100–200 $\mu$m.

24. The assembly of claim 22, wherein said plural vias are arranged about an upper perimeter of said cavity at a pitch within the range including 200–450 $\mu$m.

25. The assembly of claim 22, further comprising a connector arranged between two of said plural layers for connecting the upper ends of said plural vias.

26. The assembly of claim 25, wherein said plural vias are connected to an electrical ground in said substrate.

27. The assembly of claim 25, wherein said substrate further comprises an excitation coupling extending between said plural vias.

28. The assembly of claim 27, wherein said excitation coupling is connected to one of said plural vias by a conductor arranged between two of said plural layers.

29. The assembly of claim 15, in combination with an integrated circuit mounted on said substrate and connected to said cavity resonator via an excitation coupling, said integrated circuit comprising one of a flip chip, a bond chip, and a monolithic microwave integrated circuit.

30. The assembly of claim 29, wherein said integrated circuit comprises a voltage controlled oscillator.

* * * * *